US005573089A

United States Patent [19]

Liang

[11] Patent Number: 5,573,089

[45] Date of Patent: Nov. 12, 1996

[54] LATERALLY MOVABLE WHEELED SUITCASE WITH IMPROVED HANDLE

[76] Inventor: Joseph Liang, P.O. Box 1060, Alpine, N.J. 07620

[21] Appl. No.: 270,175

[22] Filed: Jul. 1, 1994

[51] Int. Cl.[6] ..... A45C 5/14; A45C 13/26

[52] U.S. Cl. ..... 190/18 A; 190/39; 190/115; 280/37; 280/47.2

[58] Field of Search ..... 190/18 A, 18 R, 190/115, 117, 39; 280/37, 47.2, 655, 655.1

[56] References Cited

U.S. PATENT DOCUMENTS

| | | | |
|---|---|---|---|
| 2,416,752 | 3/1947 | Hendrick | 190/18 A X |
| 4,117,914 | 10/1978 | Snyder | 190/115 |
| 4,256,320 | 3/1981 | Hager | 190/18 A X |
| 4,311,222 | 1/1982 | Castanier | 190/18 A |
| 4,358,005 | 11/1982 | Fontana | 190/115 X |
| 4,679,670 | 7/1987 | Wickman | 190/18 A |
| 4,890,705 | 1/1990 | Pineda | 190/18 A |
| 5,323,887 | 6/1994 | Scicluna et al. | 190/18 A |

FOREIGN PATENT DOCUMENTS

| | | | |
|---|---|---|---|
| 187318 | 7/1986 | European Pat. Off. | 190/15.1 |

*Primary Examiner*—Sue A. Weaver
*Attorney, Agent, or Firm*—Cohen, Pontani, Lieberman, Pavane

[57] ABSTRACT

An article of luggage exhibits improved mobility characteristics by mounting two sets of wheels to its bottom surface and a slidable and pivotable handle to its top surface. A first set of wheels projects from the bottom surface to a height greater than the projection of a second set of wheels so that the article is highly maneuverable when the article is in its upright orientation supported by the first set of wheels. The second wheels project from the bottom surface at a location more closely proximate a transverse edge of the bottom surface than the first wheels so that when the article is tilted about the second wheels, it may be stably maneuvered by a user during fast-paced movement or cornering.

9 Claims, 4 Drawing Sheets

LATERALLY MOVABLE WHEELED SUITCASE WITH IMPROVED HANDLE

FIELD OF THE INVENTION

The present invention relates to articles of luggage, generally, and more particularly to articles of luggage having rolling means for user-selectable movement on an underlying support surface.

DISCUSSION OF THE PRIOR ART

To assist travelers who are often burdened with heavy and unwieldy articles of luggage, manufacturers of articles of luggage have offered various configurations of wheels and handles in the design of such articles. Although many of these arrangements offer the user greater mobility by decreasing the physical efforts required to manipulate these articles at places such as airports and hotels, they often add bulk, weight, design complexity and cost to an otherwise simply constructed and relatively inexpensive article of luggage. Also, many of these designs offer varied degrees of maneuverability and stability during use. Indeed, an article designed with mobility facilitating means may overturn if a traveler or user walks too fast or turns a corner too quickly because the article has a high center of gravity and a small footprint and/or the user is unable to forcibly counter the momentary overturning force; moreover, an article may be rendered non-maneuverable and thus require a user to lift the heavy and unwieldy article if the design requires a large turning radius—space that may be unavailable at places such as the typically tight and tortuous waiting lines in front of ticket counters at an airport.

SUMMARY OF THE INVENTION

It is therefore an object of this invention to provide rolling means in an article of luggage with enhanced maneuverability while providing additional rolling means and handling means to facilitate stable, controllable, and fast-paced movement of such an article.

Another object of this invention is to provide an article of luggage of this type with minimal additional bulk, weight, design complexity, and cost.

The foregoing and other objects and advantageous features of the instant invention are achieved by the provision of two: sets of rolling means and a slidable and pivotable handle to an article of luggage having a top surface, a bottom surface, a front and a back surface. A direction from the front surface to the back surface defines an axis of normal rolling movement of the article. A direction substantially transverse to the aforementioned axis defines a lateral direction. There are two sets of rolling means with varying heights projecting from the article's bottom surface and a slidable and pivotable handle mounted on the article's top surface.

The first set of rolling means are distributed across the bottom surface to support the weight of the article when the article is oriented upright, and more significantly it enables a user to maneuver the article in tight places. The second set of rolling means, of lesser height than the first set, is located more closely proximate a transverse edge of the bottom surface than the first set so that when a user laterally tilts the article about the second set of rolling means by grasping the slidable and pivotable handle on its top surface, the second set becomes engaged with the support surface. While the article is in this laterally tilted state, the user can achieve stable, controlled and fast-paced movement of the article.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
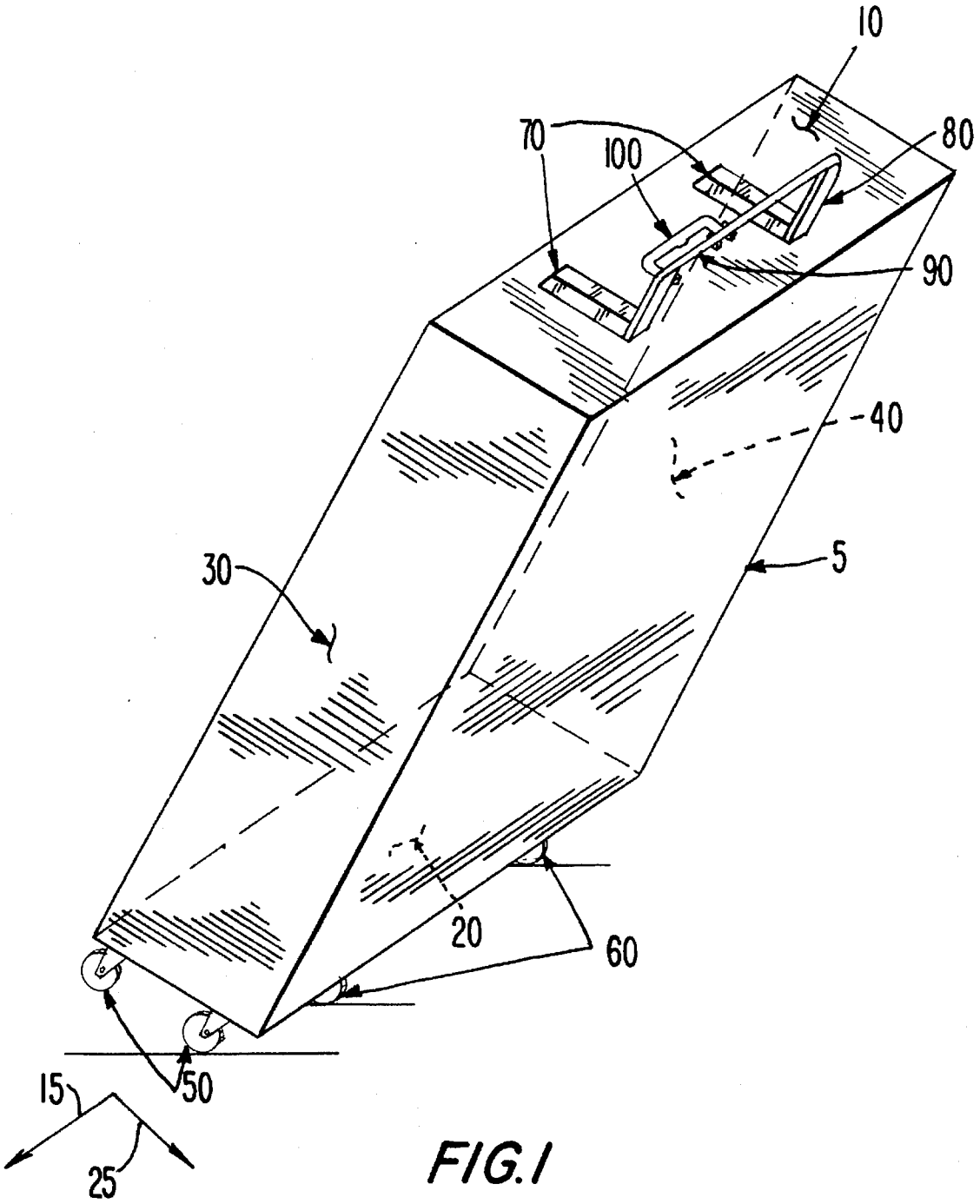
FIG. 1 is a perspective view of an article of luggage embodying the two sets of rolling means and the slidable and pivotable handle of the invention and depicted in a laterally tilted state.

Referring now to the drawings, and more particularly to FIG. 1 thereof, an article of luggage 5 constructed in accordance with a preferred embodiment of the present invention is shown to have a top exterior surface 10, a bottom exterior surface 20, a front exterior surface 30, and a back exterior surface 40. A direction from the front surface 30 to the back surface 40 defines an axis 15 of normal rolling movement of the article 5 while a direction 25 substantially transverse to the aforementioned axis defines a lateral direction of movement.

Figure 2:
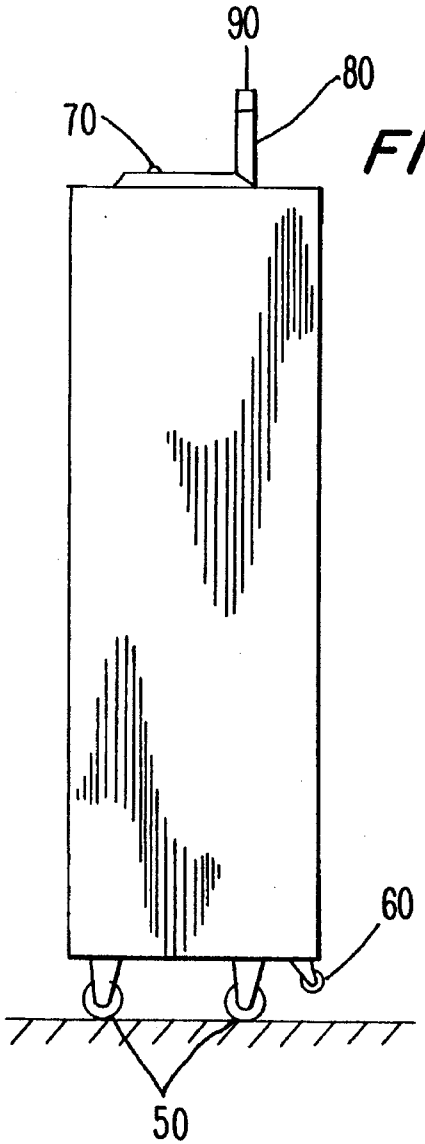
FIG. 2 is a front view of the article of luggage showing the different heights of the first and second rolling means when the article is in its upright orientation.

As seen in FIG. 2, a first set of rolling means or wheels 50 project from the bottom surface 20 to a first height from the bottom surface 20. A second set of rolling means or wheels 60 also project from the bottom surface 20, and have a second height from the bottom surface 20, which second height is less than the first height of the first rolling means 50 so that when the article 5 is standing upright, only the first rolling means 50 contact the underlying ground surface to support the weight of the article 5. In that upright orientation, the article of luggage 5 is in its most readily maneuverable state. This may be clearly seen when the first rolling means 50 comprise, for example, pivotally and rotatably mounted wheels such as casters.

Figure 3:
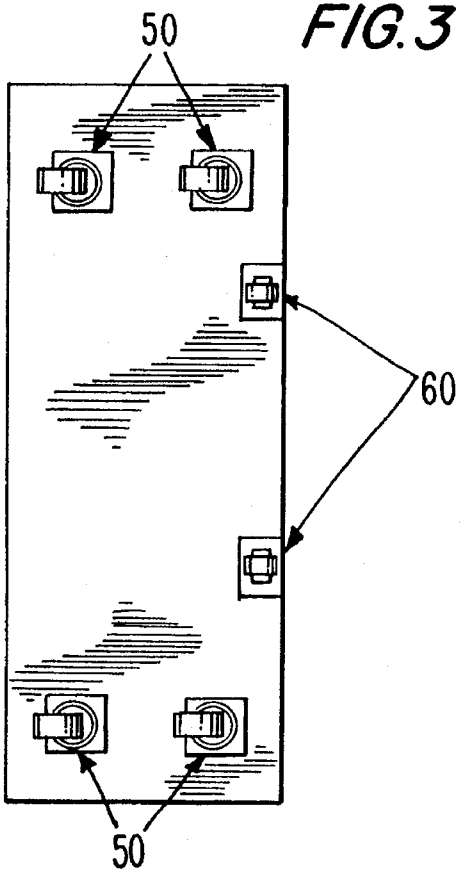
FIG. 3 is a bottom view of the article of luggage showing the spatial distribution of the first and second rolling means.

The second rolling means 60 are located more closely proximate a transverse edge of the article of luggage 5 than the first rolling means 50 so that when the article 5 is tilted laterally about the second rolling means 60, the second rolling means engage the underlying support surface as depicted in FIG. 1; in this laterally-tilted state, the weight of the article 5 is supported by both the second rolling means 60 as well as the first rolling means 50. This selective engagement of the first and second rolling means 50, 60 may be accomplished through a suitable spatial distribution of the first and second rolling means such as that shown in FIG. 3.

In the laterally-tilted state, the article of luggage 5 can be stably maneuvered by a user during fast-paced movement or cornering. To further improve the ability of the article 5 to track the user-selected direction of movement, wheels or rollers having a fixed orientation may be used for the second rolling means 60. Since those second rollers can then only rotate about a single axis, they will be effective to prevent the article 5 from varying from the intended direction of travel while the article 5 is being pulled.

Figure 4:
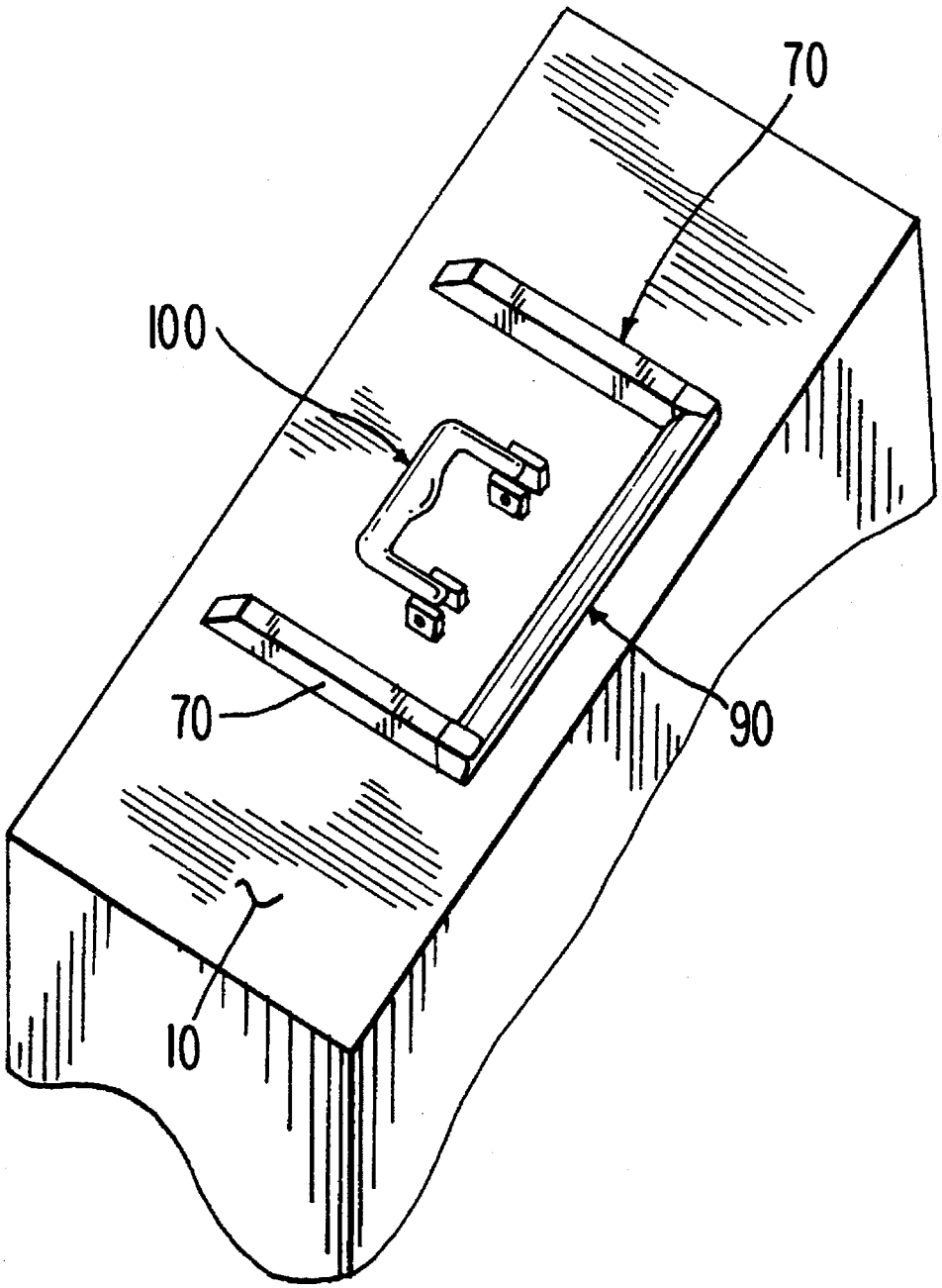
FIG. 4 is a perspective view of the top surface of the article showing the slidable and pivotable handle means of the invention in a retracted state.

The problem of luggage overturning is solved by strategically locating a slidable and pivotable handle means 65 of the invention on the top surface 10 of the article of luggage 5. At such a location, the user can easily resist the overturning force of an article of luggage 5 during an abrupt change of direction or the like. As seen in FIG. 4, a conventional handle 100 may also be located proximate the slidable and pivotable handling means 65 on the top surface 10 for maneuvering the article of luggage 5 in its upright state.

Figure 5:
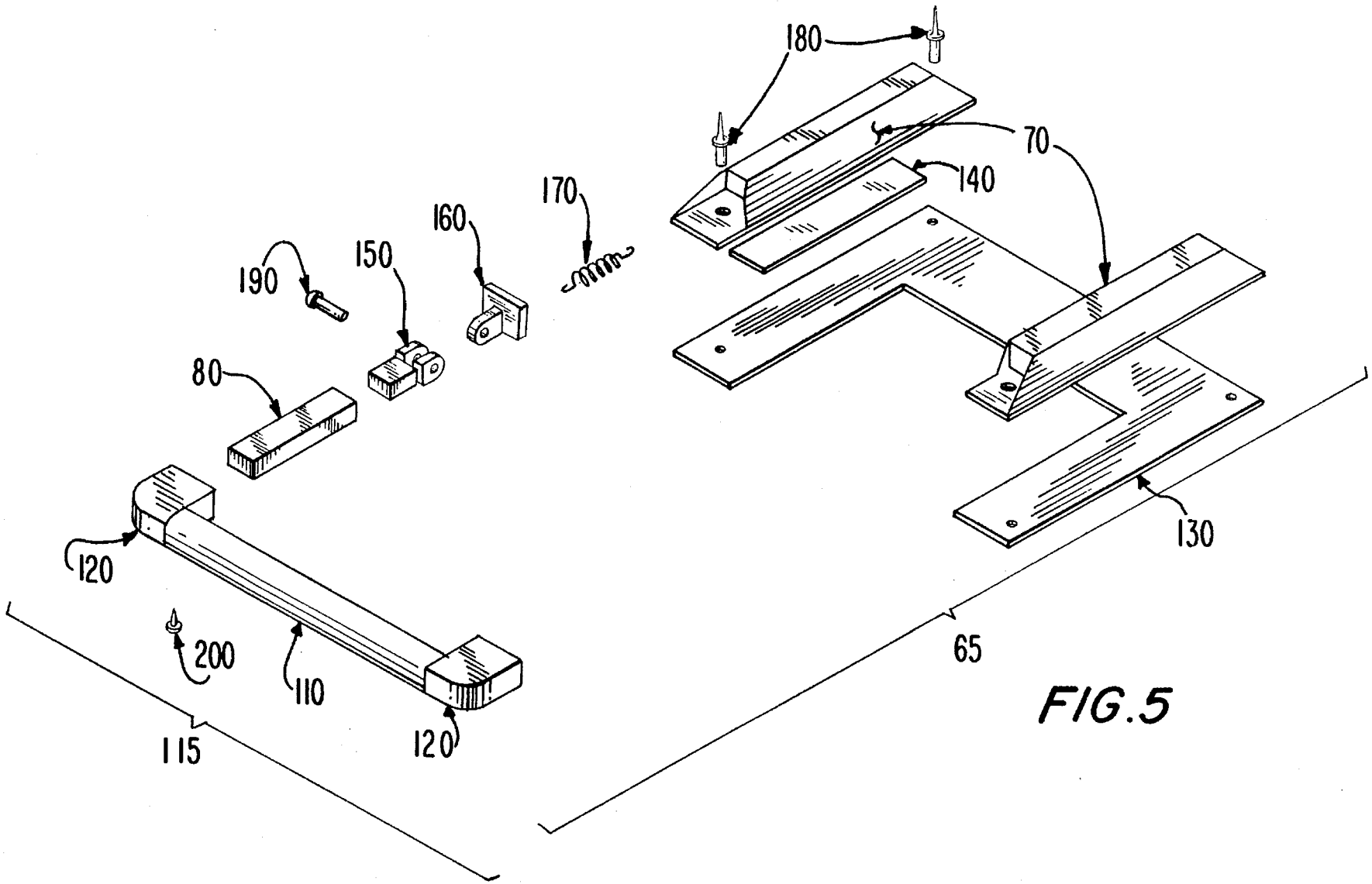
FIG. 5 is an exploded view of the slidable and pivotable handle means.

The handle means 65, in an exploded view of the preferred embodiment shown in FIG. 5, comprises a handle structure 115 having an extension portion 80 and a graspable portion 90, and a pair of channel casings 70. The handle means 65 further includes a compression spring 170 connected to a channel casing 70 at one end and to an anchor member 160 at the other. The anchor member 160 is sized for slidable receipt in the casing 70, the anchor member 160 being slidably moveable between a first and a second position so that, with the aid of the compression spring 170, the anchor member 160 is resiliently urged toward the first position. When the anchor member 160 is at that first position, the handle means 65 is in its retracted state with a substantial portion of the handle extension portion 80 slidably contained within the channel casings 70.

The anchor member 160 is pivotally or hingedly connected to a hinge member 150 through pivoting means such, for example, through the use of a rotatably received pin 190. The hinge member 150 is also sized for slidable receipt in the casing 70. The handle extension portion 80 is fixedly attached to the hinge member 150 at one end and is secured to a handle bar retainer 120 at the other. A handle bar 110 is attached to the handle bar retainers 120 through fastening means such, for example, as wood screws 200. The handle bar 110 and handle bar retainers 120 form the handle graspable portion 90. As seen in FIG. 5, the handle structure 115 thereby defines a substantially rigid U-shaped member.

The channel casings 70 are attached to the top surface 10 of the article 5 by fastening the casings 70 to a base plate 130 located within the article 5 and to an intermediate plate 140 located outside the article 5 through fastening means such, for example, as rivets 180. The channel casings 70 are oriented in the lateral direction along the top surface 10. With the anchor member 160 in its second position and the extension portion 80 extended outwardly from the casings 70, the handle structure 115 may be pivoted upwardly away from the top surface 10 of the article 5 so that the graspable portion 90 is readily graspable by a user. Moreover, the handle structure 115 remains substantially perpendicular to the top surface 10 when the article 5 is in its laterally-tilted state with the user grasping the handle. The perpendicularity of the pivoted handle structure may be implemented, for example, through the geometric shapes of the casings 70 and the handle extension portion 80.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. An article of luggage for rolling movement along an underlying support surface in a user-selectable direction, said article comprising:

a top surface;

a bottom surface having a transverse edge and disposed in confronting opposition to the underlying support surface for rolling movement of the article of luggage along the support surface;

a front surface and a back surface defining from said front to said back surface an axis of normal rolling movement of the article along the support surface;

first rolling means for facilitating user-selected rolling movement of the article along the support surface along said axis, said first rolling means comprising a plurality of rollers projecting outwardly from said bottom surface to a first height from said bottom surface so that the article is self-standingly supported on said first rolling means when the article is in an upright orientation with said first rolling means in engagement with the support surface;

second rolling means for facilitating user-selected rolling movement of the article in a lateral direction substantially transverse to said axis, said second rolling means being located on said bottom surface more closely proximate said transverse edge of said bottom surface than said first rolling means, said second rolling means projecting from said bottom surface to a second height from said bottom surface less than said first height so that said second rolling means is noncontactingly spaced from the underlying support surface when said article is in said upright orientation self-standingly supported by said first rolling means and so that, when the article is laterally tilted about said second rolling means in a direction substantially transverse to said axis, the article is supported on both said first and second rolling means; and handle means for user-initiated selective movement of the article along the support surface in said lateral direction substantially transverse to said axis with said article laterally tilted about said second rolling means in said direction substantially transverse to said axis.

2. The article of luggage according to claim 1, wherein said handle means comprises:

means for defining a channel substantially aligned with the top surface of the article;

an anchor member disposed in the channel defined by said channel defining means, said anchor member being dimensioned and arranged for captive sliding movement along said channel from a first position to a second position; and a handle structure having an extension portion from which a graspable portion depends, said extension portion being pivotally connected to said anchor member such that said extension portion is substantially retracted in said channel when said anchor member is in said first position and such that said extension portion extends outwardly from said channel when said anchor member is in said second position for pivotal movement of said extension portion upwardly away from said top surface.

3. The article of luggage according to claim 2, further comprising means in said channel and on said anchor member for resiliently urging said anchor member from said second position to said first position so that said extension portion remains substantially retracted in said channel during periods of nonuse.

4. The article of luggage according to claim 2, wherein said channel defining means is mounted along said top surface.

5. The article of luggage according to claim 4, wherein said channel defining means comprises a pair of casings each having a bore therethrough and oriented in a direction substantially transverse to said axis.

6. The article of luggage according to claim 2, wherein said handle structure comprises a substantially rigid U-shaped member.

7. The article of luggage according to claim 1, wherein said first rolling means comprises a plurality of casters.

8. The article of luggage according to claim 1, wherein said second rolling means comprises a roller having a fixed orientation.

9. An article of luggage for rolling movement along an underlying support surface in a user-selectable direction, said article comprising:

a top surface;

a bottom surface having a transverse edge;

a front surface and a back surface defining from said front to said back surface an axis of normal rolling movement of the article along the support surface;

first rolling means for facilitating user-selected rolling movement of the article along the support surface along said axis, said first rolling means comprising a plurality of casters projecting outwardly from said bottom surface to a first height from said bottom surface so that the article is supported on said first rolling means when the article is in an upright orientation with said first rolling means in engagement with the support surface;

second rolling means for facilitating user-selected rolling movement of the article in a lateral direction substantially transverse to said axis, said second rolling means being located on said bottom surface more closely proximate said transverse edge of said bottom surface than said first rolling means, said second rolling means projecting from said bottom surface to a second height from said bottom surface less than said first height so that, when the article is laterally tilted about said second rolling means in a direction substantially transverse to said axis, the article is supported on both said first and second rolling means; and handle means for user-initiated selective movement of the article along the support surface in said lateral direction substantially transverse to said axis.

* * * * *